US006845359B2

(12) United States Patent
Ramabadran

(10) Patent No.: US 6,845,359 B2
(45) Date of Patent: Jan. 18, 2005

(54) FFT BASED SINE WAVE SYNTHESIS METHOD FOR PARAMETRIC VOCODERS

(75) Inventor: Tenkasi Ramabadran, Naperville, IL (US)

(73) Assignee: Motorola, Inc., Schaumburg, IL (US)

( * ) Notice: Subject to any disclaimer, the term of this patent is extended or adjusted under 35 U.S.C. 154(b) by 615 days.

(21) Appl. No.: 09/814,991

(22) Filed: Mar. 22, 2001

(65) Prior Publication Data

US 2002/0184026 A1 Dec. 5, 2002

(51) Int. Cl.[7] ..... G10L 19/14
(52) U.S. Cl. ..... 704/266; 704/258; 704/268; 704/269
(58) Field of Search ..... 704/258, 265, 704/268, 269, 266; 708/404, 405, 400, 403, 420

(56) References Cited

U.S. PATENT DOCUMENTS 4,937,873 A * 6/1990 McAulay et al. ..... 704/265
5,832,437 A * 11/1998 Nishiguchi et al. ..... 704/268

OTHER PUBLICATIONS

T.V. Ramabadran et al., "An efficient synthesis method for sinusoidal vocoders," Proc. IEEE Workshop on Speeching Coding 2000, pp.44–46, Sep. 2000.*

R.J. McAulay et al., "Computational efficient sine–wave synthesis and its application to sinusoidal transform coding," ICASSP '88, vol. 1, pp.370–373, Apr. 1988.*

R.J. McAulay et al., "Speech analysis/synthesis based on a sinusoidal representation," IEEE Trans. on Acoustics, Speech, and Signal Processing, vol.34, No. 4, pp.744–754, Aug. 1986.*

* cited by examiner

*Primary Examiner*—Susan McFadden
(74) *Attorney, Agent, or Firm*—Kenneth A. Haas

(57) ABSTRACT

A Fast Fourier Transform (FFT) based voice synthesis method 110, program product and vocoder. Sounds, e.g., speech and audio, are synthesized from multiple sine waves. Each sine wave component is represented by a small number of FFT coefficients 116. Amplitude 120 and phase 124 information of the components may be incorporated into these coefficients. The FFT coefficients corresponding to each of the components are summed 126 and, then, an inverse FFT is applied 128 to the sum to generate a time domain signal. An appropriate section is extracted 130 from the inverse transformed time domain signal as an approximation to the desired output. FFT based synthesis 110 may be combined with simple sine wave summation 100, using FFT based synthesis 110 for complex sounds, e.g., male voices and unvoiced speech, and sine wave summation 100 for simpler sounds, e.g., female voices.

39 Claims, 7 Drawing Sheets

```
      /*
102   *INITIALIZE THE OUTPUT ARRAY WITH ZEROS
      */

      for (i=0;i<iNumSamp;i++)
      {
        pfOut[i]=0.0;                                          (1)
      }

      /*
104   *SYNTHESIZE EACH SINE WAVE AND ADD IT TO THE OUTPUT
      */

      for (j=0;j<iNumSine;j++)
      {

        fPhase=pfInitPhase[j];                                 (1)

        fAmp=pfInitAmp[j]:                                     (1)

        fDeltaPhase=pfOmega[j]:                                (1)

        fDeltaAmp=(pfFinalAmp[j]-pfInitAmp[j])*ONE_OVER_NUM_SAMP;  (2)

        for (i=0;i<NumSamp;i++)
        {

          iPhaseIndex=fPhase*SINE_TABLE_NORM_SIZE;             (1)

          fVal=pfSine[iPhaseIndex];                            (1)

          fVal*=fAmp;                                          (1)

          pfOut[i]+=fVal;                                      (1)

          fPhase+=fDeltaPhase;                                 (1)

          fAmp+=fDeltaAmp;                                     (1)

        }

      }
```

100

*FIG. 1*

```
112   /*
      *INITIALIZE THE FFT ARRAY WITH ZEROS
      */

      for (i=0;i<FFT_SIZE_BY_2;i++)
      {
        pfFFTReal[i]=0.0;                                    (1)

        pfFFTImag[i]=0.0;                                    (1)

      }

      /*
114   *DETERMINE THE FFT COEFFICIENTS CORRESPONDING TO EACH
      *SINE WAVE AND ADD TO THE FFT ARRAY
      */

      for (j=0;j<iNumSine;j++)
      {

        /*
116     *COMPUTE THE FFT FREQUENCY INDEX AND THE OFFSET INDEX
        *INTO THE COEFFICIENT TABLE
        */

        iFreqIndex=pfOmega[j]*FFT_SIZE_BY_2;                 (1)

        fOmegaOffset=pfOmega[j]-iFreqIndex*FFT_OMEGA_STEP_SIZE;  (2)

        iOffsetIndex=fOmegaOffset*COEF_TABLE_NORM_SIZE+0.5;  (2)

        /*
118     *GET THE (REAL) FFT COEFFICIENTS FROM THE COEFFICIENT TABLE
        */

        for (k=0;k<MAX_NUM_COEF_BY_2;k++)
        {
          pfRealTemp[MAX_NUM_COEF_BY_2-k]=
            pfCoefTable[iOffsetIndex+k*SIZE_RATIO];          (1)
```

110

*FIG. 2A*

```
        pfRealTemp[MAX_NUM_COEF_BY_2+k+1]=
        pfCoefTable[SIZE_RATIO-iOffsetIndex+k*SIZE_RATIO];        (1)
    }

    /*
120 *INCORPORATE THE AMPLITUDE INFORMATION INTO THE COEFFICIENTS
    */

    /*
    *GET THE AMPLITUDE MODULATION COEFFICIENTS
    */

    fA=pfFinalAmp[j]*A_CONST_1+pfInitAmp[j]*A_CONST_2;            (2)

    fB=(pfFinalAmp[j]-pfInitAmp[j])*B_CONST;                      (2)

    /*
122 *CONVOLVE THE FFT COEFFICIENTS AND THE AMPLITUDE MODULATION
    *COEFFICIENTS
    */

    pfImagTemp[0]=pfRealTemp[1]*fB;                               (1)

    pfImagTemp[1]=pfRealTemp[2]*fB;                               (1)

    pfImagTemp[MAX_NUM_COEF]=
      -pfRealTemp[MAX_NUM_COEF-1]*fB;                             (1)

    pfImagTemp[MAX_NUM_COEF+1]=
      -pfRealTemp[MAX_NUM_COEF]*fB;                               (1)

    for(k=2;k<MAX_NUM_COEF;k++)
    {
      pfImagTemp[k]=(pfRealTemp[k+1]-pfRealTemp[k-1])*fB;         (2)
    }

    for (k=1;k<=MAX_NUM_COEF;k++)
    {
      pfRealTemp[k]*=fA;                                          (1)
    }
```

110

*FIG. 2B*

```
      /*
124   *INCORPORATE PHASE INFORMATION INTO THE COEFFICIENTS
      */

      /*
      *GET THE PHASE SHIFT COEFFICIENT
      */

      iPhaseIndex=pfPhase[j]*SINE_TABLE_NORM_SIZE;                    (1)

      fReal=pfSine[iPhaseIndex+SINE_TABLE_NORM_SIZE_BY_2];            (1)

      fImag=pfSine[iPhaseIndex];                                      (1)

      /*
126   *MULTIPLY THE FFT COEFFICIENTS WITH THE PHASE SHIFT COEFFICIENT AND
      *SAVE THE RESULT IN THE FFT ARRAY
      */

      for(i=0;<MAX_NUM_COEF_BY_2;i++)
      {

        pfFFTReal[iFreqIndex+1+i]+=
          pfRealTemp[MAX_NUM_COEF_BY_2+1+i]*fReal;                    (1)

        pfFFTReal[iFreqIndex+1+i]-=
          pfImagTemp[MAX_NUM_COEF_BY_2+1+i]*fImag;                    (1)

        pfFFTImag[iFreqIndex+1+i]+=
          pfRealTemp[MAX_NUM_COEF_BY_2+1+i]*fImag;                    (1)

        pfFFTImag[iFreqIndex+1+i]+=fit
          pfImagTemp[MAX_NUM_COEF_BY_2+1+i]*fReal;                    (1)

      }

      pfFFTReal[iFreqIndex+MAX_NUM_COEF_BY_2+1]-=
        pfImagTemp[MAX_NUM_COEF+1]*fImag;                             (1)

      pfFFTImag[iFreqIndex+MAX_NUM_COEF_BY_2+1]+=
        pfImagTemp[MAX_NUM_COEF+1]*fReal;                             (1)
```

110

*FIG. 2C*

```
for (i=0;i<MAX_NUM_COEF_BY_2;i++)
{
   pfFFTReal[iFreqIndex-i]+=
      pfRealTemp[MAX_NUM_COEF_BY_2-i]*fReal;                    (1)

   pfFFTReal[iFreqIndex-i]-=
      pfImagTemp[MAX_NUM_COEF_BY_2-i]*fImag;                    (1)

   pfFFTImag[iFreqIndex-i]+=
      pfRealTemp[MAX_NUM_COEF_BY_2-i]*fImag;                    (1)

   pfFFTImag[iFreqIndex-i]+=
      pfImagTemp[MAX_NUM_COEF_BY_2-i]*fReal;                    (1)

}

pfFFTReal[iFreqIndex-MAX_NUM_COEF_BY_2]-=
   pfImagTemp[0]*fImag;                                         (1)

pfFFTImag[iFreqIndex-MAX_NUM_COEF_BY_2]+=
   pfImagTemp[0]*fReal;                                         (1)

}

/*
*PERFORM IFFT TO OBTAIN THE TIME-DOMAIN SIGNAL
*/

ifft(pfFFTReal,pfFFTImag,pfSig);                                (4200)

/*
*COPY THE OUTPUT TO THE OUTPUT ARRAY
*/

for(i=0;i<NumSamp;i++)
{
   pfOut[i]=pfSig[i+SHIFT];                                     (1)
}
```

110

FIG. 2D

FFT BASED SINE WAVE SYNTHESIS METHOD FOR PARAMETRIC VOCODERS

BACKGROUND OF THE INVENTION

1. Field of the Invention

The present invention generally relates to sound synthesis and more particularly to speech synthesis, synthesized by combining multiple sine wave harmonics.

2. Background Description

In many state of the art parametric voice coders (vocoders), e.g., sinusoidal vocoders and multi-band excitation vocoders, the output speech is synthesized as the sum of a number of sine waves. For voiced speech, the sine wave components correspond to different harmonics of the pitch frequency inside the speech bandwidth with actual or modeled phases. For unvoiced speech, the sine waves correspond to harmonics of a very low frequency (e.g., the lowest pitch frequency) with random phases. Mixed-voiced speech can be synthesized by combining pitch harmonics in the low-frequency band with random-phase harmonics in the high frequency band.

In a typical vocoder implementation (with 8 KHz sampling), the number of sine wave components needed to synthesize speech can range from 8 to 64. A straightforward synthesizer implementation involves generating each component with appropriate phase and amplitude and then, summing all the sine wave components. The computational complexity of this brute-force, straightforward approach is directly proportional to the number of sine wave components combined to make up the synthesized speech waveform. When the number of sine waves is high, the complexity is also high. Further, depending on the number of sine waves to be generated and combined, the computational load placed on the processor can vary significantly.

Thus there is a need for faster, simpler voice synthesis techniques and vocoders using such techniques especially to reduce the vocoder complexity and also to balance the processor load better while synthesizing complex speech.

BRIEF DESCRIPTION OF THE DRAWINGS

The foregoing and other objects, aspects and advantages will be better understood from the following detailed preferred embodiment description with reference to the drawings, in which:

FIG. 1 shows C language code for a synthesis subroutine or macro, illustrating how speech can be synthesized using a sine wave lookup table;

FIGS. 2 A–D show an example of C code for a subroutine or macro, implementing the preferred embodiment Fast Fourier Transform (FFT) based approach;

DETAILED DESCRIPTION OF A PREFERRED EMBODIMENT OF THE INVENTION

Figure 3:
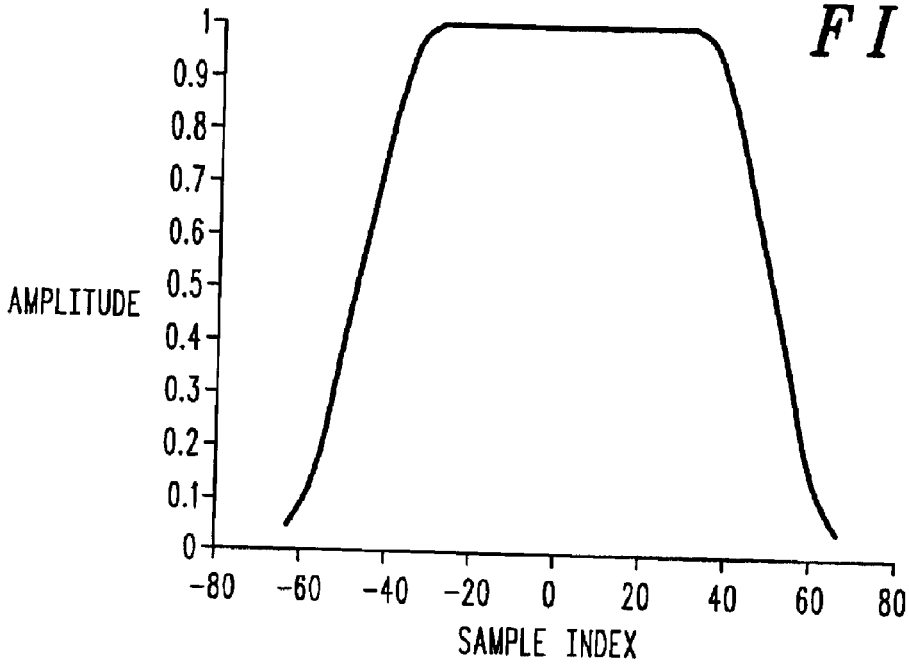
FIG. 3 shows a 127-point real, even, time domain window.

A Fast Fourier Transform (FFT) based voice synthesis method, program product and vocoder is disclosed in which, each sine wave component is represented by a small number of FFT coefficients. Amplitude and phase information of the component are also incorporated into these coefficients. The FFT coefficients corresponding to each of the components are summed and, then, an inverse FFT transform is applied to the sum to generate a time domain signal. An appropriate section is extracted from the inverse-transformed time domain signal as an approximation to the desired output. Irrespective of the included number of sine wave components, the present invention has a fixed minimum computational complexity because of the inverse FFT. However, because each component is efficiently represented by only a few FFT coefficients, the rate of increase of computational complexity is smaller than in prior art approaches, wherein the complexity is linearly proportional to the number of sine wave components. Thus, when a significant number of components are included, the total computational complexity of the preferred embodiment approach is more efficient than traditional approaches. In addition, the computational load on the processor is better balanced when the number of sine wave components varies because a major part of the vocoder complexity is essentially constant; while for prior art approaches, the fixed part is insignificant and almost the entire complexity is directly proportional to the number of sine wave components.

TABLE 1

| | |
|---|---|
| SINE_TABLE_NORM_SIZE | Normalized size of the sine wave table (size that corresponds to a phase range of $\pi$) |
| ONE_OVER_NUM_SAMP | (1.0/iNumSamp) |
| i, j | Indices |
| iNumSamp | Number of speech samples to be synthesized |
| iNumSine | Number of sine waves to be synthesized |
| iPhaseindex | Index into the sine wave table |
| pfInitAmp[] | Initial amplitudes |
| pfFinalAmp[] | Final amplitudes |
| pfOmega[] | Frequencies |
| pfOut[] | Output array |
| pfSine[] | Sine wave table |
| fAmp | Amplitude |
| fDeltaAmp | Amplitude change |
| fPhase | Phase |
| fDeltaPhase | Phase change |
| fVal | Value of a sine wave sample |

Understanding of the described embodiment may be facilitated first with reference to a state of the art straightforward synthesis approach. For the purpose of evaluating the computational complexity of the straightforward approach, consider the synthesis of iNumSamp samples of speech made up of iNumSine sine waves. For this approach, it is assumed that the initial phases, initial amplitudes, and final amplitudes of the sine waves are known. Also, the frequencies of the components are assumed to be constant over the iNumSamp samples. This situation may correspond, for example, to the synthesis of a subframe of speech over which the pitch period is held constant and, any phase correction needed to meet boundary phase conditions is linearly distributed over all the samples within a frame which corresponds to a small frequency shift so that the sine wave component frequencies are still constant. Further, for this example, the amplitude of each sine wave is constrained to change linearly from its initial to its final value.

FIG. 1 shows an example of C language code for a straightforward approach voice coder (vocoder) synthesis subroutine or macro 100, illustrating how speech can be synthesized using a sine wave lookup table. Table 1 provides a list of parameters and variables of the vocoder synthesis subroutine or macro 100 of FIG. 1 with corresponding definitions. Thus, after initializing the output array (pfOut[ ]) to zero in step 102, the straightforward approach synthesis macro 100 simply adds each included sine wave component in step 104 to arrive at the final synthesized signal.

For the purpose of evaluating complexity of this example, each line of code is assigned a weight, assignments, additions, multiplications, multiply-adds, and shifts each being assigned a weight of one (1). Branches are assigned a unit weight equal to the number of branches. Since many modem Digital Signal Processor (DSP) chips are capable of performing complex index manipulations concurrent with other operations, index manipulations do not add to the complexity and so, are not assigned any weight. The computational complexity of the straightforward approach synthesis can be calculated from FIG. 1 and expressed by the relationship:

$$CC1 = i\text{NumSine}*(5+i\text{NumSamp}*6)+i\text{NumSamp}.$$

So, for a typical iNumSamp value of 45, $$CC1 = i\text{NumSine}*275+45\sim i\text{NumSine}*275.$$

Thus, it is apparent from this straightforward approach example that the complexity is approximately directly proportional to the number of sine wave components that need to be included. For the normal component range of 8 to 64 for iNumSine, the computational complexity ranges from 2245 to 17645 and at 24, CC1=6645.

TABLE 2

| | |
|---|---|
| A_CONST_1, A_CONST_2, B_CONST | Constants used for the computation of the amplitude modulation coefficients |
| COEF_TABLE_NORM_SIZE | Normalized size of the coefficient table, i.e., the number of coefficient values corresponding to a frequency range of π |
| FFT_SIZE_BY_2 | One half the size of the FFT, i.e., the number of FFT coefficients corresponding to a frequency range of π |
| FFT_OMEGA_STEP_SIZE | Width of a FFT bin, i.e., π/FFT_SIZE_BY_2 |
| MAX_NUM_COEF | Maximum number of coefficients used to represent each synthesized sine wave |
| MAX_NUM_COEF_BY_2 | MAX_NUM_COEF/2 |
| SINE_TABLE_NORM_SIZE | Normalized size of the sine value lookup table, i.e., the size that corresponds to a phase range of π |
| SINE_TABLE_NORM_SIZE_BY_2 | SINE_TABLE_NORM_SIZE/2 |
| SIZE_RATIO | Ratio of the normalized sizes of the coefficient table and FFT, i.e., COEF_TABLE_NORM_SIZE/FFT_SIZE_BY_2 |
| SHIFT | Shift value used to extract the output from the "sum of sines" signal obtained using the FFT based approach |
| i, j ,k | Indices |
| iFreqIndex | Index into the FFT array |
| iNumSamp | Number of speech samples to be synthesized |
| iNumSine | Number of sine waves to be synthesized |

TABLE 2-continued

| | |
|---|---|
| iOffsetIndex | Index into the coefficient table |
| iPhaseIndex | Index into the sine value table |
| pfCoefTable[] | Coefficient table |
| pfRealTemp[] | Temporary array to hold the real component of the FFT coefficients |
| pfImagTemp[] | Temporary array to hold the imaginary component of the FFT coefficients |
| pfInitAmp[] | Initial amplitudes |
| pfFinalAmp[] | Final amplitudes |
| pfFFTReal[] | Real component of the FFT array |
| pfFFTImag[] | Imaginary component of the FFT array |
| pfOmega[] | Frequencies |
| pfOut[] | Output array |
| pfPhase[] | Phases |
| pfSig[] | "Sum of sines" signal obtained by lFFT of the FFT array |
| pfSine[] | Sine value table |
| fA, fB | Amplitude modulation coefficients |
| fReal | Real component of the phase shift coefficient |
| fImag | Imaginary component of the phase shift coefficient |
| fOmegaOffset | Frequency offset |

FIGS. 2 A–D show an example of C code for a vocoder subroutine or macro 110, implementing the preferred embodiment Fast Fourier Transform (FFT) based approach. In the preferred embodiment approach, each sine wave is represented by a few appropriately selected FFT coefficients. Table 2 provides a list of parameters and variables included in the example 110 of FIGS. 2A–D each with a corresponding definition.

First, in step 112 of this preferred embodiment, the FFT array is initialized with zeros. Then, beginning in step 114, the FFT coefficients for each sine wave are determined and added to the FFT array. In step 116 both a frequency index into the FFT array and an offset index into the coefficient table are computed for each sine wave component. The frequency index is determined for each component by multiplying that frequency by FFT_SIZE_BY_2. The offset index is the distance between the component frequency and the nearest lower FFT bin frequency measured in terms of the frequency resolution of the coefficient table. In step 118 the real FFT coefficients for the component are selected from the coefficient table. Then, in step 120 amplitude modulation information may be incorporated into the coefficients. So, amplitude modulation coefficients are retrieved and, in step 122 the component FFT coefficients are convolved with the amplitude modulation coefficients. If amplitude modulation is not included the modulation coefficient fB is zero and the convolution operation is replaced by simple multiplication of the component FFT coefficients by the modulation coefficient fA. Next, in step 124 phase information may be incorporated into the coefficients. Phase shift coefficients are extracted and in step 126 multiplied by the component FFT coefficients. The result of the multiplication is added to the FFT array. In step 128, an inverse FFT (IFFT) is performed to obtain a time domain signal from the FFT array and an appropriate section of this time domain signal is copied to the output array in step 130.

The FFT based approach C language code example 110 of FIGS. 2A–D is simplified by including only those sections that correspond to the most commonly encountered control flow branch. The possible branches the control flow can take are: 1) Depending on whether the frequency of the sine wave to be synthesized is an exact FFT bin frequency or not, the number of FFT coefficients required to represent the sine wave is 1 or MAX_NUM_COEF, respectively (For this example, it is assumed that MAX_NUM_COEF are required to represent each sine wave component); 2) Since the signal to be synthesized is real, the corresponding Fourier Transform has conjugate symmetry and, therefore, only one half of the FFT array (for example, the positive frequency half) needs to be computed and stored. However, for the case where the sine wave frequency component approaches DC (0 Hz), it is possible that some of the FFT coefficients, representing the sine wave may fall on zero or negative frequency bins. For this situation, these zero or negative frequency coefficients are folded back around DC, conjugated, and added to the previously existing coefficient values. The number of possible branches that this scenario generates is equal to MAX_NUM_COEF_BY_2+1. So, in the example of FIGS. 2A–D, the branch that leads to no folding around DC frequency is chosen. A similar situation potentially exists near the frequency bin corresponding to π. However, if the maximum component frequency limit is below a particular value (e.g., 3750 Hz for MAX_NUM_COEF=8, and 8 KHz sampling frequency), then there is only one branch as has been assumed in the FFT based approach program code 110 of this example.

As in the straightforward approach example 100 of FIG. 1, a complexity weight is assigned to each line of code. Denoting the size of the FFT by FFT_SIZE (which is 2*FFT_SIZE_BY_2), it is clear that the number of samples to be synthesized, viz., iNumSamp, should not exceed FFT_SIZE. For the ifft( ) function in step 128, the complexity shown (4200) is for an FFT_SIZE of 128. This complexity measure for the ifft( ) function was determined using a C program code not included here. Such program code is available from several standard references, e.g., see W. H. Press, S. A. Teukolsky, W. T. Vetterling, and B. P. Flannery, "Numerical Recipes in C: The Art of Scientific Computing," Second Edition, Cambridge University Press, 1992. In determining the complexity of the 128-point ifft( ) function, an implementation with a 64-point complex ifft( ) function that exploits the conjugate symmetry of the FFT array was used.

It can be seen from this example that the number of coefficients required depends upon whether the particular component frequency is one of the FFT bin frequencies, viz., (i*(π/FFT_SIZE_BY_2)), i=0, 1, . . . , FFT_SIZE_BY_2−1. If the component frequency is a bin frequency, then a single coefficient at the appropriate frequency bin is enough to represent the component sine wave exactly. On the other hand, if the component frequency falls in between two bin frequencies, then an exact representation requires all of the FFT_SIZE coefficients. However, a fairly accurate approximation results from choosing a small number of coefficients corresponding to the bin frequencies around the desired sine wave frequency. If the time domain signal is suitably windowed, then, its energy can be concentrated near the sine wave frequency, thereby increasing the accuracy of representation for a given number of coefficients.

Figure 4:
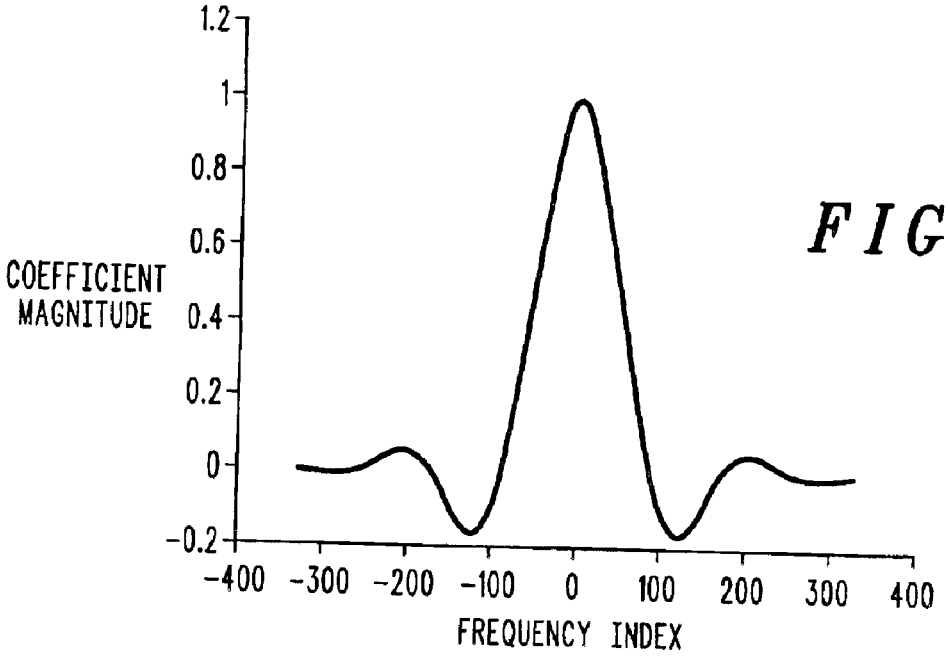
FIG. 4 shows coefficient values derived by transforming the time-domain window of FIG. 3 by an FFT with $\pi/4096$ ($2\pi/8192$) resolution and stored in a Coefficient Table.

So, for example, FIG. 3 shows a 127-point real, even, time domain window. The middle 63 values of the window have unity amplitude. The 32 values on either side are taken from a 64-point Kaiser window with a window shape parameter (β) value of 4.7. Because the time domain signal is real and even, its Fourier transform is also real and even. This is illustrated in FIG. 4, wherein 8192-point FFT of the signal in FIG. 3 is (magnitude) normalized and truncated to 641 points. It should be noted that the coefficient values on either side decay to zero fairly quickly because of the Kaiser window sections used in the time domain signal. In fact, the section shown in FIG. 4 contains more than 99.99% of the total energy in the signal. The coefficient values shown in FIG. 4 have a frequency resolution of π/4096 (2π/8192) and are stored in a "Coefficient Table," viz., pfCoefTable[ ] in the example C code subroutine or macro 110 of FIGS. 2A–D. Only one half of the values need to be stored because of even symmetry in the coefficient values. The Coefficient Table can be used to approximate sine waves, as described hereinbelow.

To illustrate the case where the desired sine wave frequency $\omega_d$ falls between the bin frequencies, take a sine wave of frequency $\omega_d$=0.2442*π, for example, and FFT_SIZE_BY_2=64, such that $\omega_d$ falls between (15*(π/64)) and (16*(π/64)). The Coefficient Table corresponding to FIG. 4 is placed such that its center is as close to the desired frequency as possible. Because the frequency resolution of the Coefficient Table is (π/4096), the desired frequency can be approximated by a multiple of this resolution, which is $\omega_a$=(1000*(π/4096))=0.244140625*π. Using 8 coefficients, 4 on either side of the desired frequency, the center of the resulting Coefficient Table may be set on $\omega_a$, its closest approximating frequency and, the values corresponding to (i*(π/64)), i=12, 13, 14, 15, 16, 17, 18, and 19 are determined.

In this example, since the first FFT frequency bin to the left of $\omega_a$ is (15*(π/64))=(960*(π/4096)), the offset index corresponding to this bin is simply 1000−960=40. The indices of the $14^{th}$, $13^{th}$, and $12^{th}$ bins, which are each 64 (i.e., SIZE_RATIO=4096/64) apart from each other, are 104, 168 and 232, respectively. Similarly, the index corresponding to the $16^{th}$ bin is 64−40=24 and, the indices corresponding to the $17^{th}$, $18^{th}$, and $19^{th}$ bins, which are also 64 apart from each other, are 88, 152, and 216, respectively. It should be noted that, if the desired maximum number of coefficients is 8 (4 on either side), then the number of FFT coefficients that must be stored is only 4*64+1=257.

Figure 5A:
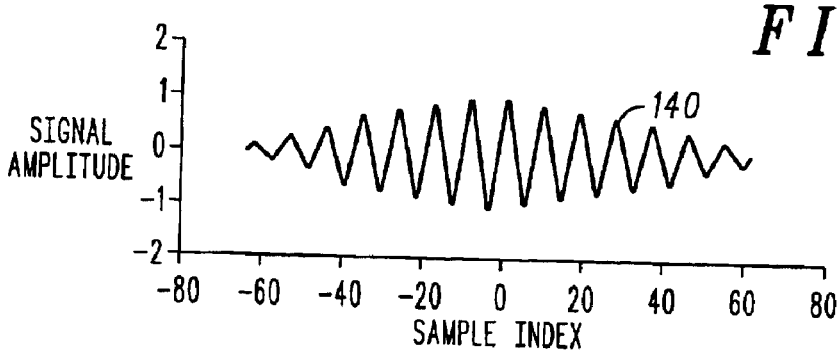
FIG. 5A shows an example of a time-domain signal synthesized by an inverse FFT (IFFT) of 8 coefficient values chosen to approximate a sine wave signal with frequency $0.2442*\pi$.
Figure 5B:
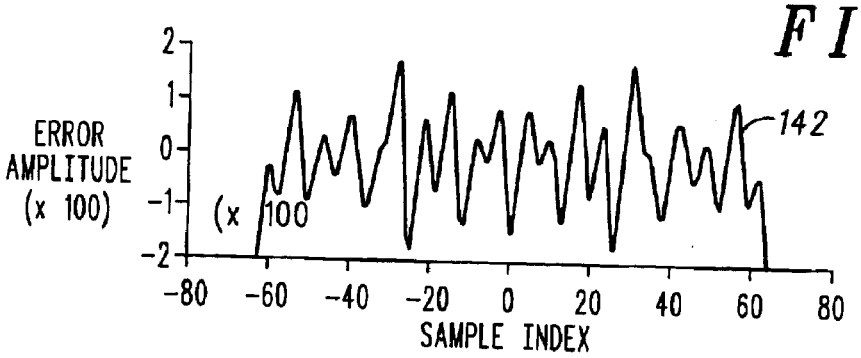
FIG. 5B shows an error signal derived by subtracting the synthesized signal of FIG. 5A from a computed sine wave signal at frequency $0.2442*\pi$ and windowed using the signal in FIG. 3.

FIG. 5A shows a time domain signal 140 obtained by a 128-point inverse FFT (IFFT) of the 8 FFT coefficients (12 through 19) chosen as described above. The remaining coefficients in the positive frequency half are set to zero and the coefficients in the negative frequency half are obtained by complex conjugation. FIG. 5B shows an error signal 142 derived by computing an original sine wave signal (not shown) at the desired frequency $\omega_d$=0.2442*π, windowing it with the signal shown in FIG. 3, and then subtracting the synthesized signal of FIG. 5A from the windowed signal. Because the middle section of the synthesized signal 140 is flat, a sine wave of suitable length can be extracted from this section (up to a maximum of 63 samples). For the middle 45 samples, the signal to noise ratio (SNR) or more accurately signal to approximation error ratio is 39.6 dB. In fact, the worst-case SNR with 8 coefficients is 37 dB for the middle 45 samples. By increasing to only 10 coefficients, the worst-case SNR can be raised to about 41 dB. Further improvement is possible by increasing the size and thereby the frequency resolution of the Coefficient Table.

In typical sinusoidal synthesis, it is often necessary to modulate the amplitude of the sine wave linearly from one value to another. While linear amplitude modulation is difficult to achieve in the FFT based approach without increasing complexity, an approximately linear amplitude modulation is achieved in step 122 using a 3-point coefficient sequence of the form, {jB, A, −jB} corresponding to the frequency bins −π/64, 0 and π/64 respectively. An IFFT of this sequence yields the time domain signal $$a(i)=A+2*B*\sin(i*(\pi/64))$$

for i=−64, . . . , 0, . . . , 63. The middle section of this time domain signal, a(i), is an approximation to linear amplitude modulation. If no amplitude modulation is required, we set B=0, so that a(i)=A, a constant value. Given the initial and final amplitudes of a sine wave component, it is a relatively simple matter to calculate the necessary values of A and B.

Figure 6:
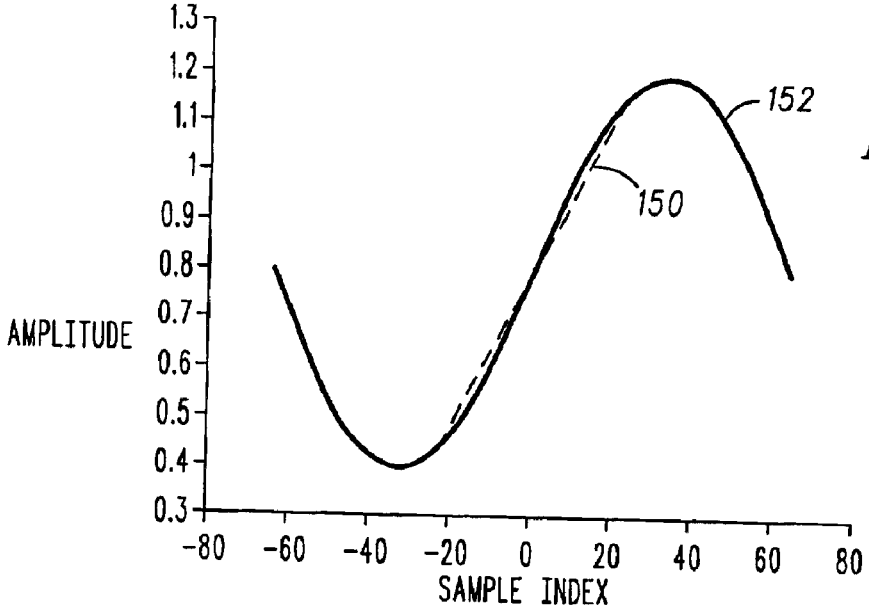
FIG. 6, shows a time-domain signal resulting from A=0.8 and B=0.2 for amplitude modulation of a synthesized sine wave signal.

FIG. 6, for example, shows a time domain signal resulting from A=0.8 and B=0.2. The samples of a(i) at i=−22 and i=22 are connected by a dotted line 150 to show the difference between linear amplitude modulation (dotted line 150) and the approximate linear amplitude modulation (solid line 152) for the middle 45-sample segment. It can be seen that as i changes from −22 to +22 amplitude changes from 0.447 to 1.153. Although the resulting approximation is not particularly good in this example, linear amplitude modulation is used only for convenience. Thus, the approximate linear modulation is not expected to have adverse effects on speech quality.

Since a point-wise multiplication of a synthesized sine wave with appropriate amplitudes in the time domain is desired, in step 122 the FFT coefficients corresponding to the sine wave must be convolved in the frequency domain with the appropriate 3-point amplitude modulation coefficient sequence computed in step 120. In addition, any required phase at sample index 0 may be provided by simply multiplying in step 126 the FFT coefficients corresponding to the sine wave by the phase shift coefficient derived in step 124 as Cos(phase)+j*Sin(phase).

To compare the computational complexity of the preferred FFT based approach 110 with the straightforward synthesis approach 100, consider synthesis of iNumSamp samples of speech made up of iNumSine sine wave components, as described hereinabove for the straightforward approach example. Further, for this comparison, the initial amplitudes, final amplitudes, and the phases at the midpoints (corresponding to sample index 0 in FIGS. 3, 5A–B and 6) of the sine waves are known. Also, for this comparison, the component frequencies are held constant over the iNumSamp samples. For the FFT based macro 110, assume for this comparison that FFT_SIZE=128 and, accounting for the branches not shown in the program, the computational complexity of the FFT based approach can be calculated as:

$$CC2=i\text{NumSine}*(18+\text{MAX_NUM_COEF}*9)+i\text{NumSamp}+4328.$$

For a typical iNumSamp value of 45 and MAX_NUM_COEF of 8, $$CC2=i\text{NumSine}*90+4373.$$

For the range of 8 to 64 for iNumSine, the computational complexity of the FFT based approach ranges from 5093 to 10133 and at 24, CC2=6533.

Thus, comparing the above results the preferred embodiment FFT based synthesis approach can be used to improve speech synthesis in parametric vocoders under some circumstances. As shown hereinabove, for the example where the number of samples, iNumSamp=45, FFT_SIZE=128, and the number of coefficients used to represent each sine wave, MAX_NUM_COEF=8; the complexity of the straightforward approach and the FFT based approach, respectively, can be represented as:

$$CC1=i\text{NumSine}*275+45;\ \text{and}$$

$$CC2=i\text{NumSine}*90+4373.$$

Clearly, when the number of sine waves to be generated exceeds a certain threshold, 24 in this example, the FFT based approach 110 has an advantage over the straightforward approach 100. That is, for iNumSine values greater than or equal to the 24 sine wave component threshold, the FFT based approach is less complex. For iNumSine values below that threshold, i.e., less than 24, the straightforward approach is less complex.

Furthermore, it is known that for voiced speech, the number of pitch harmonics (or sine waves) to be synthesized is typically less than 24 for female speakers and greater than 24 for male speakers. Thus the FFT based approach is advantageous for synthesizing speech for male speakers and the straightforward approach is advantageous for synthesizing speech for female speakers. Unvoiced speech is typically synthesized using a large number of random-phase sine wave components, where the FFT-based approach 110 has a clear advantage. In fact, it is not difficult to arrange the vocoder such that the frequencies of the sine waves corresponding to unvoiced speech lie exactly on the FFT bin frequencies so that each sine wave component is represented by a single FFT coefficient, thereby lowering the synthesis or vocoder complexity even further. If male and female speeches are equally likely to occur in a particular application, the FFT-based approach 110 has an advantage over the straightforward approach 100 in terms of computational complexity because of the significant presence of unvoiced speech in any speech material. In addition, the computational load on the processor is better balanced, i.e., 1:2 for the FFT-based approach 110 versus 1:8 for the straightforward approach 100. Thus, in another preferred embodiment, both the straightforward approach 100 and the FFT-based approach 110 are used selectively, to exploit the strengths of both.

While the invention has been described in terms of preferred embodiments, those skilled in the art will recognize that the invention can be practiced with modification within the spirit and scope of the appended claims.

I claim:

1. A method of synthesizing a complex sound, said method comprising the steps of:

a) generating a coefficient table, said coefficient table containing fast Fourier transform (FFT) coefficients for each of a plurality of sine wave components;

b) extracting FFT coefficients from said coefficient table;

c) summing corresponding ones of said extracted FFT coefficients;

d) performing an inverse FFT on said summed corresponding FFT coefficients; and e) providing results of said inverse FFT as a synthesized sound output.

2. A method as in claim 1, wherein amplitude modulation and phase are included in the step (c) of summing corresponding FFT coefficients, step (c) comprising the steps of:

i) convolving said extracted FFT coefficients with amplitude modulation coefficients;

ii) multiplying said convolved FFT coefficients with phase shift coefficients; and iii) summing corresponding ones of said multiplied FFT coefficients, the sum being provided to the inverse FFT of step (d).

3. A method as in claim 2, wherein said sine wave components have constant amplitude, said amplitude modulation coefficients including a single non-zero coefficient, said non-zero coefficient being a constant value, said step (i) of convolving comprising multiplying said FFT coefficients by said non-zero coefficient.

4. A method as in claim 2 wherein said amplitude modulation coefficients for each component are determined from initial and final amplitudes of said each component.

5. A method as in claim 4, said amplitude modulation coefficients for said each component being a 3-point complex-conjugate sequence of the form {+jB,A,−jB}, and wherein A and B are constants.

6. A method as in claim 5 wherein said phase shift coefficients for said each component are determined from a desired phase of said each component at a selected time index.

7. A method as in claim 6, said phase shift coefficients for said each component having the form [Cos( )+j*Sin( )], being the phase of said each component at time index zero.

8. A method as in claim 2 wherein real FFT coefficients are extracted in the extraction step (b) and convolved with amplitude modulation coefficients.

9. A method as in claim 8 wherein the step (a) of generating the coefficient table comprises the steps of:

i) windowing a selected time domain signal; and ii) determining FFT coefficients of said windowed signal, said determined FFT coefficients being entered in said coefficient table.

10. A method as in claim 9 wherein, windowing the time domain signal comprises taking a real, even time domain window of said signal.

11. A method as in claim 10 wherein the said time domain signal is DC.

12. A method as in claim 10 wherein the step (ii) of determining FFT coefficients further comprises:

A) taking a FFT of said windowed signal;

B) truncating results of said FFT; and

C) storing the truncated results of said FFT in said coefficient table.

13. A method as in claim 12 wherein truncating said FFT comprises magnitude normalizing said FFT results and selecting a central coefficient and an equal number of coefficients to either side of said central coefficient, selected said coefficients being stored in said coefficient table.

14. A method as in claim 13 wherein said selected central coefficient and said number of coefficients to one side of said central coefficient are stored in said coefficient table.

15. A method as in claim 14, wherein said FFT is a 8192 point FFT.

16. A method as in claim 14, wherein said coefficient table is generated and stored for subsequent sound synthesis prior to beginning synthesis.

17. A method as in claim 8 wherein the step (b) of extracting FFT coefficients from said coefficient table comprises the steps of:

i) initializing an FFT array, FFT array coefficients being entries in said coefficient table;

ii) selecting a subset of coefficients from said coefficient table for each component; and iii) selecting a subset of locations within said FFT array for each component, said selected subset of locations corresponding to said selected subset of coefficients.

18. A method as in claim 17 wherein the minimum component number is 24.

19. A method as in claim 1 before the coefficient table generation step (a), further comprising the steps of:

a1) determining a number of components to be included in a sound to be synthesized;

a2) proceeding to step (a) if said determined number exceeds a selected minimum component number; otherwise, a3) synthesizing each component to be included in said synthesized sound; and a4) adding each synthesized component to an output, the sum of synthesized components being said synthesized output.

20. A vocoder for synthesizing voices, said vocoder comprising:

means for generating a coefficient table, said coefficient table containing coefficients for each component included in a voice being synthesized;

means for extracting fast Fourier transform (FFT) coefficients from said coefficient table;

summing means for adding corresponding ones of said extracted FFT coefficients;

ifft means for performing an inverse FFT on said summed corresponding FFT coefficients; and output means for providing results of said inverse FFT as a synthesized voice.

21. A vocoder as in claim 20, the summing means comprising:

convolution means for convolving said FFT coefficients with amplitude modulation coefficients;

multiplication means for multiplying said convolved FFT coefficients with phase shift coefficients; and summing means for adding corresponding ones of said multiplied FFT coefficients, the sum being provided to said ifft means.

22. A vocoder as in claim 21 further comprising:

means for determining amplitude modulation coefficients for each component from initial and final amplitudes of said each component.

23. A vocoder as in claim 22 wherein determined said amplitude modulation coefficients are a 3-point complex-conjugate sequence of the form {+jB,A,−jB}, and wherein A and B are constants.

24. A vocoder as in claim 23 further comprising:

means for determining phase shift coefficients for said each component from a desired phase of said each component at a selected time index.

25. A vocoder as in claim 24, determined said phase shift coefficients having the form [Cos( )+j*Sin( )], being the phase of said each component at time index zero.

26. A vocoder as in claim 21, wherein said extraction means extracts real FFT coefficients, said real FFT coefficients being convolved with amplitude modulation coefficients.

27. A vocoder as in claim 26, said means for generating the coefficient table comprising:

windowing means for windowing a selected time domain signal; and means for determining FFT coefficients of said windowed signal, said determined coefficients being entered in said coefficient table.

28. A vocoder as in claim 27, said means for extracting FFT coefficients comprising:

initialization means for initializing an FFT array, FFT array coefficients being entries in said coefficient table;

means for selecting a subset of coefficients from said coefficient table for each component; and means for selecting a subset of locations within said FFT array for each component, said selected subset of locations corresponding to said selected subset of coefficients.

29. A vocoder as in claim 28 further comprising:

means for determining a number of components to be included in a sound to be synthesized; and means for synthesizing each component to be included in said synthesized sound responsive to said determined number being less than a selected minimum and adding adding each synthesized component to an output, the sum of synthesized components being said synthesized output.

30. A computer program product for synthesizing voices, said computer program product comprising a computer usable medium having computer readable program code thereon, said computer readable program code comprising:

computer readable program code means for generating a coefficient table, said coefficient table containing coefficients for each component included in a voice being synthesized;

computer readable program code means for extracting fast Fourier transform (FFT) coefficients from said coefficient table;

computer readable program code means for adding corresponding ones of said extracted FFT coefficients;

computer readable program code means for performing an inverse FFT on said summed corresponding FFT coefficients; and computer readable program code means for providing results of said inverse FFT as a synthesized voice.

31. A computer program product for synthesizing voices as in claim 30, the computer program product means for adding coefficients comprising:

computer readable program code means for convolving said extracted FFT coefficients with amplitude modulation coefficients;

computer readable program code means for multiplying said convolved FFT coefficients with phase shift coefficients; and computer readable program code means for adding corresponding ones of said multiplied FFT coefficients, the sum being provided to said ifft means.

32. A computer program product for synthesizing voices as in claim 31 further comprising:

computer program product means for generating amplitude modulation coefficients from initial and final component amplitudes.

33. A computer program product for synthesizing voices as in claim 32 wherein said computer program product means for generating amplitude modulation coefficients generates a 3-point complex-conjugate sequence of the form {+jB,A,jB} for said amplitude modulation coefficients, A and B being constants.

34. A computer program product for synthesizing voices as in claim 33 further comprising:

computer program product means for generating phase shift coefficients from a desired component phase at a selected time index.

35. A computer program product for synthesizing voices as in claim 34, wherein said computer program product means for generating phase shift coefficients generates coefficients having the form [Cos( )+j*Sin( )], being component phase at a time index.

36. A computer program product for synthesizing voices as in claim 31, wherein said computer readable program code extraction means extracts real FFT coefficients, said real FFT coefficients being convolved with amplitude modulation coefficients.

37. A computer program product for synthesizing voices as in claim 36 wherein said computer readable program code means for generating said coefficient table comprises:

computer readable program code means for windowing a desired time domain signal; and computer readable program code means for determining FFT coefficients of said windowed signal, said determined coefficients being entered in said coefficient table.

38. A computer program product for synthesizing voices as in claim 37 wherein the computer readable program code means for extracting FFT coefficients from said coefficient table comprises:

computer readable program code means for initializing an FFT array, FFT array coefficients being entries in said coefficient table;

computer readable program code means for selecting a subset of coefficients from said coefficient table for each component; and computer readable program code means for selecting a subset of locations within said FFT array for each component, said selected subset of locations corresponding to said selected subset of coefficients.

39. A computer program product for synthesizing voices as in claim 38 further comprising:

computer readable program code means for determining a number of components to be included in a sound to be synthesized; and computer readable program code means for synthesizing each component to be included in said synthesized sound responsive to said determined number being less than a selected minimum and adding each synthesized component to an output, the sum of synthesized components being said synthesized output.

* * * * *